US010909913B2

(12) United States Patent
Moulton et al.

(10) Patent No.: US 10,909,913 B2
(45) **Date of Patent: *Feb. 2, 2021**

(54) WHITE OR OFF-WHITE HIDDEN DISPLAY APPARATUS, SYSTEM, AND METHOD

(71) Applicant: Vivint, Inc., Provo, UT (US)

(72) Inventors: Scott Moulton, Heber City, UT (US); Craig DeVries, Bountiful, UT (US); Stephen Edward Boynton, Pleasant Grove, UT (US)

(73) Assignee: Vivint, Inc., Provo, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/505,312

(22) Filed: Jul. 8, 2019

(65) Prior Publication Data

US 2020/0005705 A1 Jan. 2, 2020

Related U.S. Application Data

(63) Continuation of application No. 15/148,188, filed on May 6, 2016, now Pat. No. 10,347,172.

(51) Int. Cl.

| | |
|---|---|
| ***G09G 5/00*** | (2006.01) |
| ***G09G 3/3208*** | (2016.01) |
| ***G09G 3/20*** | (2006.01) |

(52) U.S. Cl.

CPC ..... *G09G 3/3208* (2013.01); *G09G 3/2003* (2013.01); *G09G 3/2092* (2013.01); (Continued)

(58) Field of Classification Search

CPC ... G09G 2320/0233; G09G 2320/0626; G09G 2320/066; G09G 3/001; G09G 3/2096; (Continued)

(56) References Cited

U.S. PATENT DOCUMENTS 6,765,546 B2 * 7/2004 Akamine ..... B60K 35/00 345/55
7,468,721 B2 * 12/2008 Nakano ..... G06F 3/0412 345/102

(Continued)

FOREIGN PATENT DOCUMENTS

JP H10282338 * 10/1998 ..... G02F 1/133555
JP H10282338 A 10/1998

(Continued)

OTHER PUBLICATIONS

WO2015125705 (A1) Display Device, Shida Kuniaki. (Year: 2015).*
PCT International Search Report for International Application No. PCT/US2017/028502, dated Jul. 11, 2017 (3 pp.).

*Primary Examiner* — Duc Q Dinh
(74) *Attorney, Agent, or Firm* — Holland & Hart, LLP

(57) ABSTRACT

A hidden display apparatus, system, and method. A display apparatus embodiment may include a face layer and a projection layer, with the projection layer positioned behind the face layer. The face layer may include a front side and a back side. The front side may include a first area configured to display high resolution images and a second area positioned around the first area. The first area and the second area may be made of the same material, and have similar color(s) and/or patterns. The projection layer may include a light source operative in an active mode and an inactive mode. When in the active mode, the projection layer may project light to the face layer to display images in the first area. When in the inactive mode, the face layer may be visually obscured so that the first area and the second area together display a colored surface.

15 Claims, 9 Drawing Sheets

(52) U.S. Cl.
CPC ..... *G09G 2300/023* (2013.01); *G09G 2320/0686* (2013.01); *G09G 2358/00* (2013.01)

(58) Field of Classification Search
CPC ..... G09G 2300/023; G09G 2320/0686; G09G 2358/00; G09G 2300/0473; G09G 3/3433; G02F 1/133502; G02F 1/133555; G02F 1/13394; G02F 1/1508; G02F 2001/133626; G02F 1/133345; G02F 1/13338; G02F 1/1334; G02F 1/133512; G02F 1/133603; G02F 1/133606; G02F 1/133605; G02F 1/133611; G02F 1/133504; G02B 6/0055; G02B 6/0061; G02B 19/0028; G02B 6/0043; G02B 6/0076; G02B 5/22; G02B 6/0031; G02B 1/045; G02B 27/0977; G02B 5/0205; G02B 5/0226; G02B 5/0268; G02B 5/0278; G02B 5/0284; G02B 5/0294; G02B 5/206; G02B 5/223; G06F 3/044; G06F 1/1637; G06F 3/041; G06F 3/042; G06F 3/0421; G06F 3/165; G06F 3/167; G06F 3/0445; G06F 2203/04103; G06F 3/0443
USPC ..... 345/1.1, 1.2, 2.2
See application file for complete search history.

(56) References Cited

U.S. PATENT DOCUMENTS

| | | | | |
|---|---|---|---|---|
| 8,508,383 | B2 * | 8/2013 | Peterson | B60R 1/12 340/815.4 |
| 8,587,749 | B2 * | 11/2013 | Kuno | B60R 11/0235 349/96 |
| 8,735,800 | B2 | 5/2014 | Andre et al. | |
| 8,792,069 | B2 | 7/2014 | Hyytiainen | |
| 8,847,979 | B2 * | 9/2014 | Smith | G06F 3/01 345/619 |
| 9,063,359 | B2 | 6/2015 | Ek | |
| 2002/0054440 | A1 | 5/2002 | Akamine et al. | |
| 2010/0061048 | A1 | 3/2010 | Mills | |
| 2012/0026419 | A1 | 2/2012 | Takenaka et al. | |
| 2015/0062709 | A1 * | 3/2015 | Matsuyuki | C03C 17/3417 359/584 |
| 2017/0009959 | A1 * | 1/2017 | Shida | F21V 11/00 |

FOREIGN PATENT DOCUMENTS

| | | | |
|---|---|---|---|
| JP | 2010282010 | A | 12/2010 |
| KR | 20090085817 | A | 8/2009 |
| KR | 20120044811 | A | 5/2012 |
| KR | 20140127589 | A | 11/2014 |

* cited by examiner

WHITE OR OFF-WHITE HIDDEN DISPLAY APPARATUS, SYSTEM, AND METHOD

CROSS REFERENCE

The present application us a continuation of U.S. patent application Ser. No. 15/148,188, filed May 6, 2016, titled "WHITE OR OFF-WHITE HIDDEN DISPLAY APPARATUS, SYSTEM, AND METHOD", and assigned to the assignee hereof, the disclosure of this reference is incorporated herein in their entirety by this reference.

BACKGROUND

The present disclosure, for example, relates to security and/or automation systems, and more particularly to the field of electronic displays that are hidden when the displays are off.

Security and automation systems are widely deployed to provide various types of communication and functional features such as monitoring, communication, notification, and/or others. These systems may be capable of supporting communication with a user through a communication connection or a system management action.

Traditional electronic displays may include dark letters or icons on a grey display surface or background. Other, hidden electronic displays often have clear glass or other clear material over a dark face through which light shines from a backlight to display images. Dark displays, especially in some environments, may be aesthetically displeasing. Thus, it may be beneficial to provide displays that blend in better with certain environments, while still maintaining clarity of the displayed words or images.

SUMMARY

Described herein are an apparatus, system, and methods for visually obscuring a display with a white face.

According to at least one embodiment, a hidden graphical display apparatus is disclosed. In some examples, a display apparatus embodiment may include a face layer and a projection layer, with the projection layer positioned behind the face layer. In the embodiment, the face layer may include a front side and a back side, and the front side may include a first area configured to display high resolution images and a second area positioned around the first area, and the first area and the second area may be constructed of the same material. In the some embodiments, the projection layer may include a light source configured to operate in an active mode and an inactive mode. In addition, when in the active mode, the projection layer may be configured to project light from the light source to the back side of the face layer to display one or more high resolution images in the first area. Moreover, when in the inactive mode, the projection layer may be configured to visually obscure the face layer so that the first area and the second area together display a colored surface hiding the projection layer.

In some examples, the light source may project white light in the active mode. In some examples, the displayed colored surface hiding the projection layer in the inactive mode may include a white or an off-white surface.

In addition, in some examples the light source may include an organic light-emitting diode (OLED). In some examples, the projection layer and the face layer may be positioned a distance apart. The distance may be in the range of 0-0.35 millimeters in some examples, and in some examples, the OLED light source of the projection layer may be bonded to at least a part of the face layer.

Furthermore, in some examples the face layer may include a plurality of pigments. In some examples, the plurality of pigments may include at least one part Micah and at least one part titanium dioxide, and in some examples may include Micah in a range of 5%-20% and titanium dioxide in a range of 80%-95%.

In some examples where the light source projects white light in the active mode, the front side of the face layer may also include a polycarbonate sheet, and the back side may be configured to transmit 15%-45% of the projected white light. In some of those examples, the back side may further include a mask layer having an aperture aligned with the first area of the front side of the face layer.

Moreover, in some examples, the face layer may include an interactive surface. In some examples, the interactive surface may be configured to receive an input for operating one or more components of the automation and/or security system.

According to another embodiment, a method is disclosed, the method directed to visually obscuring a graphical display. A method embodiment may include selecting between an active mode and an inactive mode of a projection layer of the graphical display, the graphical display having a face layer and a projection layer, the projection layer positioned behind the face layer; and, when in the active mode, projecting white light from an OLED light source of the projection layer to the face layer to display one or more high resolution images on the face layer; and, when in the inactive mode, visually obscuring the face layer as a white or off-white surface and hiding the projection layer.

In some examples of the method embodiment, the face layer may include a plurality of pigments. In some examples, the plurality of pigments may include Micah in a range of 5%-20% and titanium dioxide in a range of 80%-95%.

In addition, in some examples of the method embodiment, the method may include maintaining a distance between the projection layer and the face layer in a range of 0-0.35 millimeters.

In still other examples of the method embodiment, the method may include, when in the active mode, displaying the one more high resolution images in a first area of a front layer of the face layer. The face layer may include the first area and a second area positioned around the first area. When in the inactive mode, the method may include visually obscuring the face layer such that the first area and the second area together display the white or off-white surface. In some examples, the first area and the second area may both be constructed of the same material According to at least one other embodiment, a non-transitory computer-readable medium storing computer-executable code is described. In some of those examples, the code may be executable by a processor to select between an active mode and an inactive mode of a projection layer of the graphical display, the graphical display having a face layer and the projection layer. The projection layer may be positioned behind the face layer. When in the active mode, white light may be projected from an OLED light source of the projection layer to the face layer to display one or more high resolution images on the face layer. When in the inactive mode, the face layer may be visually obscured as a white or off-white surface, and the projection layer may be hidden. In some embodiments, the face layer may include a plurality of pigments, the plurality of pigments including Micah in a range of 5%-20% and titanium dioxide in a range of 80%-95%.

The foregoing has outlined rather broadly the features and technical advantages of examples according to this disclosure so that the following detailed description may be better understood. Additional features and advantages will be described below. The conception and specific examples disclosed may be readily utilized as a basis for modifying or designing other structures for carrying out the same purposes of the present disclosure. Such equivalent constructions do not depart from the scope of the appended claims. Characteristics of the concepts disclosed herein—including their organization and method of operation—together with associated advantages will be better understood from the following description when considered in connection with the accompanying figures. Each of the figures is provided for the purpose of illustration and description only, and not as a definition of the limits of the claims.

BRIEF DESCRIPTION OF THE DRAWINGS

A further understanding of the nature and advantages of the present disclosure may be realized by reference to the following drawings. In the appended figures, similar components or features may have the same reference label. Further, various components of the same type may be distinguished by following a first reference label with a dash and a second label that may distinguish among the similar components. However, features discussed for various components—including those having a dash and a second reference label—apply to other similar components. If only the first reference label is used in the specification, the description is applicable to any one of the similar components having the same first reference label irrespective of the second reference label.

DETAILED DESCRIPTION

Figure 1:
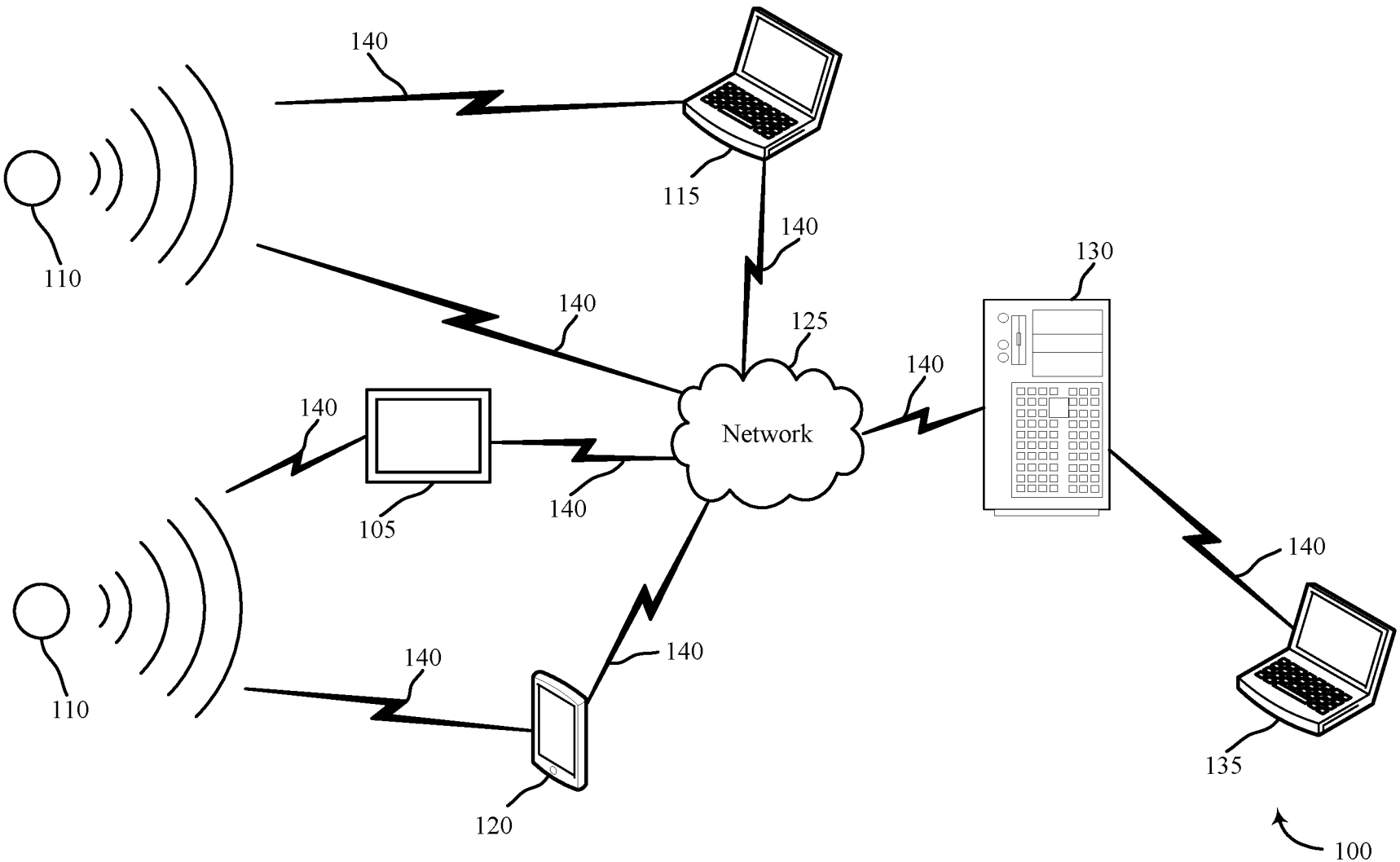
FIG. 1 shows a block diagram relating to a security and/or an automation system, in accordance with various aspects of this disclosure.

In today's highly competitive market for consumer electronics, more white and/or off-white display faces on interactive control panels, such as those used for security systems, HVAC control, and the like, would add variety and provide more choices for consumers. Such additional choices would be particularly desirable in certain environments of use, such as on all-white and/or off-white appliances and/or on devices mounted to white and/or off-white walls.

Yet there are several challenges to displaying clearly readable images using white light on hidden white graphical displays, as opposed to on more commonly used black and/or dark colored graphical displays. For example, dark display faces may provide a stark contrast from white light, while the lack of such contrast between white light and white faces may cause images to appear more blurry, and have less defined edges. Also, the dark surface of a graphical display may more effectively absorb stray light from a backlight, resulting in more crisp and better defined images. In contrast, white light may be more likely to shine through (to some extent) some white display surfaces, resulting in blurrier and less clearly defined images. Differences in transmissivity of layers may also render certain high brightness light sources (e.g., liquid crystal displays (LCD)) suitable for displaying clearly defined images on black hidden graphical displays, yet unsuitable for white hidden displays. More specifically, such high-brightness light sources may problematically light up entire white display faces, and not just an area of the display where images are intended to be displayed.

Some white graphical displays may attempt to hide white icons (but generally not changeable icons), by making material surrounding the display area a similar white color. However, due in part to the differences in materials between such fixed icons and the surrounding area, such displays are not optimally capable of being hidden or obscured from the casual observer. More specifically, in some examples, the area displaying the icons may be a transparent white plastic, but the surrounding material may be a harder, non-transparent, and therefore visually distinct, white plastic.

To varying degrees, many current hidden graphical displays—not just white displays—similarly use different materials for the area displaying images and the surrounding area (with which the displaying area is intended to blend). For example, some black hidden graphical displays incorporate clear material over a dark display face area, and a surrounding area of black-colored material, so that when backlights are off, the dark face display face area may blend in with the surrounding dark material.

Using the same material for the area displaying images as the surrounding area would enhance the capability of a display to be hidden, but may also entail certain obstacles. For example, it may be difficult to allow light to pass through an intended area of the display but not the surrounding area when the intended and surrounding areas are made of similar materials. In addition, even within the intended display area, it is challenging to allow enough light to pass through the display surface to display clearly readable images (when the light is emanated), without making the surface so transparent as to reveal the contents behind the surface (when light is not emanated).

Moreover, some pigments typically used to achieve certain colors (e.g., white) may cause undesirable refraction of light projected there-through. Blurrier images may also result from light refraction caused by excessive distance between a projecting light source and a displaying surface, and also by the thickness of the display surface, and/or the thickness of, and distance between, any other mediums through which light must pass in order to display images.

Described herein are an apparatus, system, and method for displaying clearly readable images using white light on white and light-colored faces when the display is in an active mode, yet visually obscuring the display when in an inactive mode. The apparatus, system, and method described herein may also have application for hidden displays generally regardless of particular colors involved.

The following description provides examples and is not limiting of the scope, applicability, and/or examples set forth in the claims. Changes may be made in the function and/or arrangement of elements discussed without departing from the scope of the disclosure. Various examples may omit, substitute, and/or add various procedures and/or components as appropriate. For instance, the methods described may be performed in an order different from that described, and/or various steps may be added, omitted, and/or combined. Also, features described with respect to some examples may be combined in other examples.

FIG. 1 is an example of a home automation system 100 in accordance with various aspects of the disclosure. In some embodiments, the home automation system 100 may include one or more sensor units 110, local computing device 115, 120, network 125, server 130, apparatus 105, and remote computing device 135. The network 125 may provide user authentication, encryption, access authorization, tracking, Internet Protocol (IP) connectivity, and other access, calculation, modification, and/or functions. The apparatus 105 may interface with the network 125 through wired and/or wireless communication links 140 and may perform communication configuration, adjustment, and/or scheduling for communication with local computing device 115, 120 or remote computing device 135, or may operate under the control of a controller. Apparatus 105 may communicate with a back end server 130—directly and/or indirectly—using one or more communication links 140.

The apparatus 105 may wirelessly communicate via communication links 140 with the local computing device 115, 120. The apparatus 105 may provide communication coverage for a geographic coverage area. In some examples, apparatus 105 may be referred to as a control device, a base transceiver station, a radio base station, an access point, a radio transceiver, a home automation control panel, a smart home panel, or some other suitable terminology. The geographic coverage area for apparatus 105 may be divided into sectors making up only a portion of the coverage area. The home automation system 100 may include one or more apparatus 105 of different types. The apparatus 105 may be related to one or more discrete structures (e.g., a home, a business) and each of the one more discrete structures may be related to one or more discrete areas. Apparatus 105 may be related to a smart home system panel, for example an interactive panel mounted on a wall in a user's home. In other embodiments, apparatus 105 may instead be a door locking mechanism. Apparatus 105 may be in direct communication via wired or wireless communication links 140 with the one or more sensor units 110, or may receive sensor data from the one or more sensor units 110 via local computing devices 115, 120 and network 125, or may receive data via remote computing device 135, server 130, and network 125.

The local computing devices 115, 120 may be dispersed throughout the home automation system 100 and each local computing device 115, 120 may be stationary and/or mobile. Local computing devices 115, 120 and remote computing device 135 may be custom computing entities configured to interact with one or more sensor units 110 via network 125, and in some embodiments, via server 130. In other embodiments, local computing devices 115, 120 and remote computing device 135 may be general purpose computing entities. A local computing device 115, 120 or remote computing device 135 may include a cellular phone, a personal digital assistant (PDA), a wireless modem, a wireless communication device, a handheld device, a tablet computer, a laptop computer, a cordless phone, a wireless local loop (WLL) station, a display device (e.g., TVs, computer monitors, etc.), a printer, a sensor, and/or the like. A local computing device 115, 120 may also include or be referred to by those skilled in the art as a user device, a sensor, a smartphone, an iPod®, an iPad®, a Bluetooth device, a Wi-Fi device, a mobile station, a subscriber station, a mobile unit, a subscriber unit, a wireless unit, a remote unit, a mobile device, a wireless device, a wireless communications device, a remote device, an access terminal, a mobile terminal, a wireless terminal, a remote terminal, a handset, a user agent, a mobile client, a client, and/or some other suitable terminology. A local computing device 115, 120 and/or apparatus 105 may include and/or be one or more sensors that sense: proximity, motion, temperatures, humidity, sound level, smoke, structural features (e.g., glass breaking, window position, door position), time, geo-location data of a user and/or a device, distance, biometrics, weight, speed, height, size, preferences, light, darkness, weather, time, system performance, and/or other inputs that relate to a security and/or an automation system. A local computing device 115, 120 may be able to communicate through one or more wired and/or wireless communication links 140 with various components such as control panels, base stations, and/or network equipment (e.g., servers, wireless communication points, etc.) and/or the like.

The communication links 140 shown in home automation system 100 may include uplink (UL) transmissions from a local computing device 115, 120 to an apparatus 105, and/or downlink (DL) transmissions from apparatus 105 to a local computing device 115, 120. The downlink transmissions may also be called forward link transmissions while the uplink transmissions may also be called reverse link transmissions. Each communication link 140 may include one or more carriers, where each carrier may be a signal made up of multiple sub-carriers (e.g., waveform signals of different frequencies) modulated according to the various radio technologies. Each modulated signal may be sent on a different sub-carrier and may carry control information (e.g., reference signals, control channels, etc.), overhead information, user data, etc. The communication links 140 may transmit bidirectional communications and/or unidirectional communications. Communication links 140 may include one or more connections, including but not limited to, 345 MHz, Wi-Fi, Bluetooth, cellular, Z Wave, 802.11, peer-to-peer, LAN, WLAN, Ethernet, fire wire, fiber optic, and/or other connection types related to security and/or automation systems.

In some embodiments of home automation system 100, apparatus 105 and/or local computing devices 115, 120 may include one or more antennas for employing antenna diversity schemes to improve communication quality and reliability between apparatus 105 and local computing devices 115, 120. Additionally or alternatively, apparatus 105 and/or local computing devices 115, 120 may employ multiple-input, multiple-output (MIMO) techniques that may take advantage of multi-path, mesh-type environments to transmit multiple spatial layers carrying the same or different coded data.

While the local computing devices 115, 120 may communicate with each other through the apparatus 105 using communication links 140, each local computing device 115, 120 may also communicate directly with one or more other devices via one or more direct communication links 140. Two or more local computing devices 115, 120 may communicate via a direct communication link 140 when both local computing devices 115, 120 are in the geographic coverage area or when one or neither local computing devices 115, 120 is within the geographic coverage area. Examples of direct communication links 140 may include Wi-Fi Direct, Bluetooth, wired, and/or, and other P2P group connections. The local computing devices 115, 120 in these examples may communicate according to the WLAN radio and baseband protocol including physical and MAC layers from IEEE 802.11, and its various versions including, but not limited to, 802.11b, 802.11g, 802.11a, 802.11n, 802.11ac, 802.11ad, 802.11ah, etc. In other implementations, other peer-to-peer connections and/or ad hoc networks may be implemented within home automation system 100.

In some embodiments, one or more sensor units 110 may communicate via wired or wireless communication links 140 with one or more of the local computing device 115, 120 or network 125. The network 125 may communicate via wired or wireless communication links 140 with the apparatus 105 and the remote computing device 135 via server 130. In alternate embodiments, the network 125 may be integrated with any one of the local computing device 115, 120, server 130, or remote computing device 135, such that separate components are not required. Additionally, in alternate embodiments, one or more sensor units 110 may be integrated with apparatus 105, and/or apparatus 105 may be integrated with local computing device 115, 120, such that separate components are not required.

The local computing devices 115, 120 and/or apparatus 105 may include memory, a processor, an output, a data input and a communication module. The processor may be a general purpose processor, a Field Programmable Gate Array (FPGA), an Application Specific Integrated Circuit (ASIC), a Digital Signal Processor (DSP), and/or the like. The processor may be configured to retrieve data from and/or write data to the memory. The memory may be, for example, a random access memory (RAM), a memory buffer, a hard drive, a database, an erasable programmable read only memory (EPROM), an electrically erasable programmable read only memory (EEPROM), a read only memory (ROM), a flash memory, a hard disk, a floppy disk, cloud storage, and/or so forth. In some embodiments, the local computing devices 115, 120 and/or apparatus 105 may include one or more hardware-based modules (e.g., DSP, FPGA, ASIC) and/or software-based modules (e.g., a module of computer code stored at the memory and executed at the processor, a set of processor-readable instructions that may be stored at the memory and executed at the processor) associated with executing an application, such as, for example, receiving and displaying data from one or more sensor units 110.

The processor of the local computing devices 115, 120 and/or apparatus 105 may be operable to control operation of the output of the local computing devices 115, 120 and/or apparatus 105. The output may be a television, a liquid crystal display (LCD) monitor, a cathode ray tube (CRT) monitor, speaker, tactile output device, and/or the like. In some embodiments, the output may be an interactive or non-interactive laser projection. In some embodiments, the output may be an integral component of the local computing devices 115, 120. Similarly stated, the output may be directly coupled to the processor. For example, the output may be the integral display of a tablet and/or smart phone. In some embodiments, an output module may include, for example, a High Definition Multimedia Interface™ (HDMI) connector, a Video Graphics Array (VGA) connector, a Universal Serial Bus™ (USB) connector, a tip, ring, sleeve (TRS) connector, and/or any other suitable connector operable to couple the local computing devices 115, 120 and/or apparatus 105 to the output.

The remote computing device 135 may be a computing entity operable to enable a remote user to monitor the output of the one or more sensor units 110. The remote computing device 135 may be functionally and/or structurally similar to the local computing devices 115, 120 and may be operable to receive data streams from and/or send signals to at least one of the sensor units 110 via the network 125. The network 125 may be the Internet, an intranet, a personal area network, a local area network (LAN), a wide area network (WAN), a virtual network, a telecommunications network implemented as a wired network and/or wireless network, etc. The remote computing device 135 may receive and/or send signals over the network 125 via communication links 140 and server 130.

In some embodiments, the one or more sensor units 110 may be sensors configured to conduct periodic or ongoing automatic measurements related to user approach or proximity to the one or more sensor units 110 and/or apparatus 105. Each sensor unit 110 may be capable of sensing multiple proximity parameters, or alternatively, separate sensor units 110 may monitor separate proximity parameters. For example, one sensor unit 110 may measure user approach using motion sensors, while another sensor unit 110 (or, in some embodiments, the same sensor unit 110) may detect user proximity via heat or heartbeat detection. In some embodiments, one or more sensor units 110 may additionally monitor alternate proximity parameters, such as RFID or Bluetooth signals. In alternate embodiments, a user may input proximity data directly at the local computing device 115, 120 or at remote computing device 135. For example, a user may enter proximity data into a dedicated application on his smartphone indicating that he is returning home, and the apparatus 105 may register that proximity accordingly. Alternatively or in addition, a GPS feature integrated with the dedicated application on the user's smartphone may communicate the user's proximity to his home automation system at the one or more sensor units 110 and/or apparatus 105.

In some embodiments, the one or more sensor units 110 may be separate from the apparatus 105, and may be positioned at various locations throughout the home or property. In other embodiments, the one or more sensor units 110 may be integrated or collocated with home automation system components or home appliances or fixtures. For example, a sensor unit 110 may be integrated with a doorbell system, or may be integrated with a front porch light. In other embodiments, a sensor unit 110 may be integrated with a wall outlet or switch. In still other embodiments, the one or more sensor units 110 may be integrated or collocated with the apparatus 105 itself, as discussed in more detail below with respect to FIG. 5.

Data gathered by the one or more sensor units 110 may be communicated to local computing device 115, 120, which may be, in some embodiments, a thermostat or other wall-mounted input/output smart home display. In other embodiments, local computing device 115, 120 may be a personal computer or smartphone. Data transmission may occur via, for example, frequencies appropriate for a personal area network (such as Bluetooth or IR communications) or local or wide area network frequencies such as radio frequencies specified by the IEEE 802.15.4 standard.

In some embodiments, local computing device 115, 120 may communicate with remote computing device 135 or apparatus 105 via network 125 and server 130. Examples of networks 125 may include cloud networks, local area networks (LAN), wide area networks (WAN), virtual private networks (VPN), wireless networks (using 802.11, for example), and/or cellular networks (using 3G and/or LTE, for example), etc. In some configurations, the network 125 may include the Internet. In some embodiments, a user may access the functions of local computing device 115, 120 from remote computing device 135. For example, in some embodiments, remote computing device 135 may include a mobile application that interfaces with one or more functions of local computing device 115, 120.

The server 130 may be configured to communicate with the sensor units 110, the local computing devices 115, 120, the remote computing device 135 and apparatus 105. The server 130 may perform additional processing on signals received from the one or more sensor units 110 or local computing devices 115, 120, or may simply forward the received information to the remote computing device 135 and apparatus 105.

Server 130 may be a computing device operable to receive data streams (e.g., from one or more sensor units 110 and/or local computing device 115, 120 or remote computing device 135), store and/or process data, and/or transmit data and/or data summaries (e.g., to remote computing device 135). For example, server 130 may receive a stream of occupancy or user approach data based on motion detection from a sensor unit 110, a stream of occupancy or user approach data based on vibration monitoring from the same or a different sensor unit 110, and a stream of occupancy or user approach data derived from RFID signals from either the same or yet another sensor unit 110. In some embodiments, server 130 may "pull" the data streams, e.g., by querying the sensor units 110, the local computing devices 115, 120, and/or the apparatus 105. In some embodiments, the data streams may be "pushed" from the sensor units 110 and/or the local computing devices 115, 120 to the server 130. For example, the sensor units 110 and/or the local computing device 115, 120 may be configured to transmit data as it is generated by or entered into that device. In some instances, the sensor units 110 and/or the local computing devices 115, 120 may periodically transmit data (e.g., as a block of data or as one or more data points).

The server 130 may include a database (e.g., in memory) containing user approach, occupancy or proximity data received from the sensor units 110 and/or the local computing devices 115, 120. Additionally, as described in further detail herein, software (e.g., stored in memory) may be executed on a processor of the server 130. Such software (executed on the processor) may be operable to cause the server 130 to monitor, process, summarize, present, and/or send a signal associated with user approach, occupancy or proximity data.

Figure 2A:
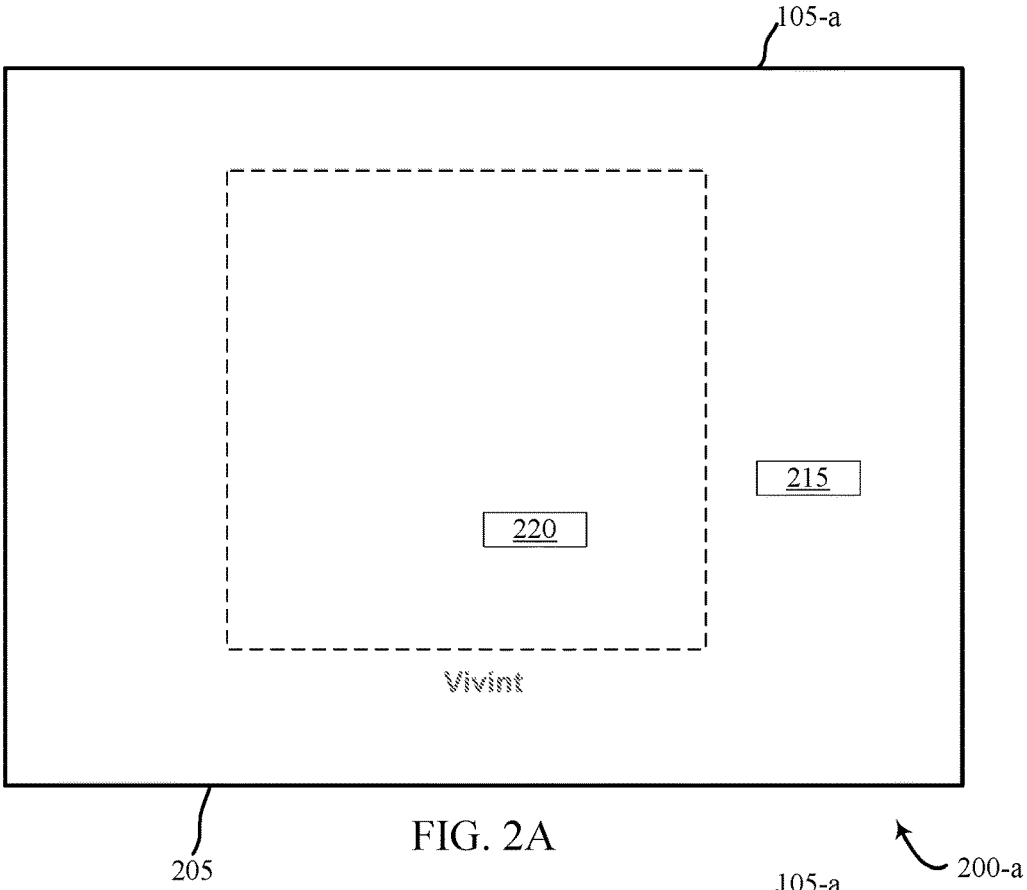
FIG. 2A is a first front view of an apparatus relating to a security and/or an automation system, in accordance with various aspects of this disclosure.
Figure 2B:
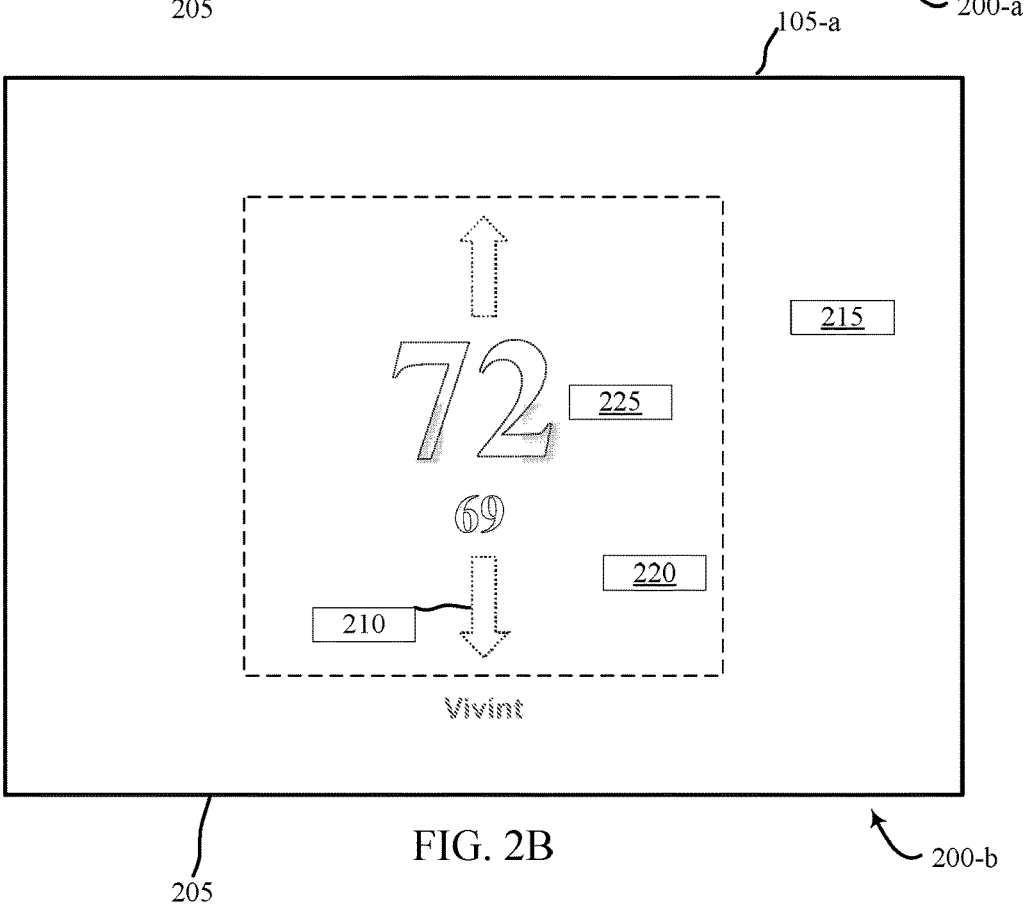
FIG. 2B is a second front view of the apparatus of FIG. 2A.

As illustrated in FIGS. 2A and 2B, apparatus 105 may include a display component that has a front layer 205. FIGS. 2A and 2B show front views of an apparatus 105-*a*. The apparatus 105-*a* may be similar in certain aspects to the apparatus 105 of FIG. 1. The apparatus 105-*a* may have an inactive mode, shown in FIG. 2A, and an active mode, shown in FIG. 2B. The apparatus 105-*a* may also have a front layer 205, shown in both front views FIG. 2A and FIG. 2B of the apparatus 105-*a*.

FIG. 2A is a front view 200-*a* of one embodiment of a hidden graphical display apparatus 105-*a* in an inactive mode, showing the front layer 205 thereof. The front layer 205 may have a first area 220 for displaying images and a second area 215 surrounding the first area 220 for blending in with the first area 220. The first area 220 and the second area 215 may be made of the same material(s) so that in the inactive mode the first area 220 may be visually indistinguishable from the second area 215. In this manner, the front layer 205 (and to at least some degree the apparatus 105-*a*) may blend in with certain surroundings in an aesthetically pleasing manner—for example, if the apparatus 105-*a* were mounted to a wall having the same color as the front layer 205, apparatus 105-*a* may blend in with the wall so as to be less visually obtrusive than an apparatus having a contrasting color display.

FIG. 2B is a front view 200-*b* of the apparatus 105-*a* of FIG. 2A in an active mode, also showing the front layer 205. In the active mode, images 225 may be displayed on the front layer 205 inside the first area 220. In some embodiments, the first area 220 may also be an interactive surface 210 (e.g., a button) allowing a user to input certain commands, using the displayed images 225. Although displayed images may vary according to embodiment, in the embodiment shown, the images 225 and interactive surface 210 may pertain to an interactive display for a wall-mounted thermostat. For example, the images 230 displayed may in the embodiment shown relate to current temperature and a desired temperature. In addition, displayed images 225 on the interactive surface 210 may also relate to adjusting the desired temperature.

Figure 3:
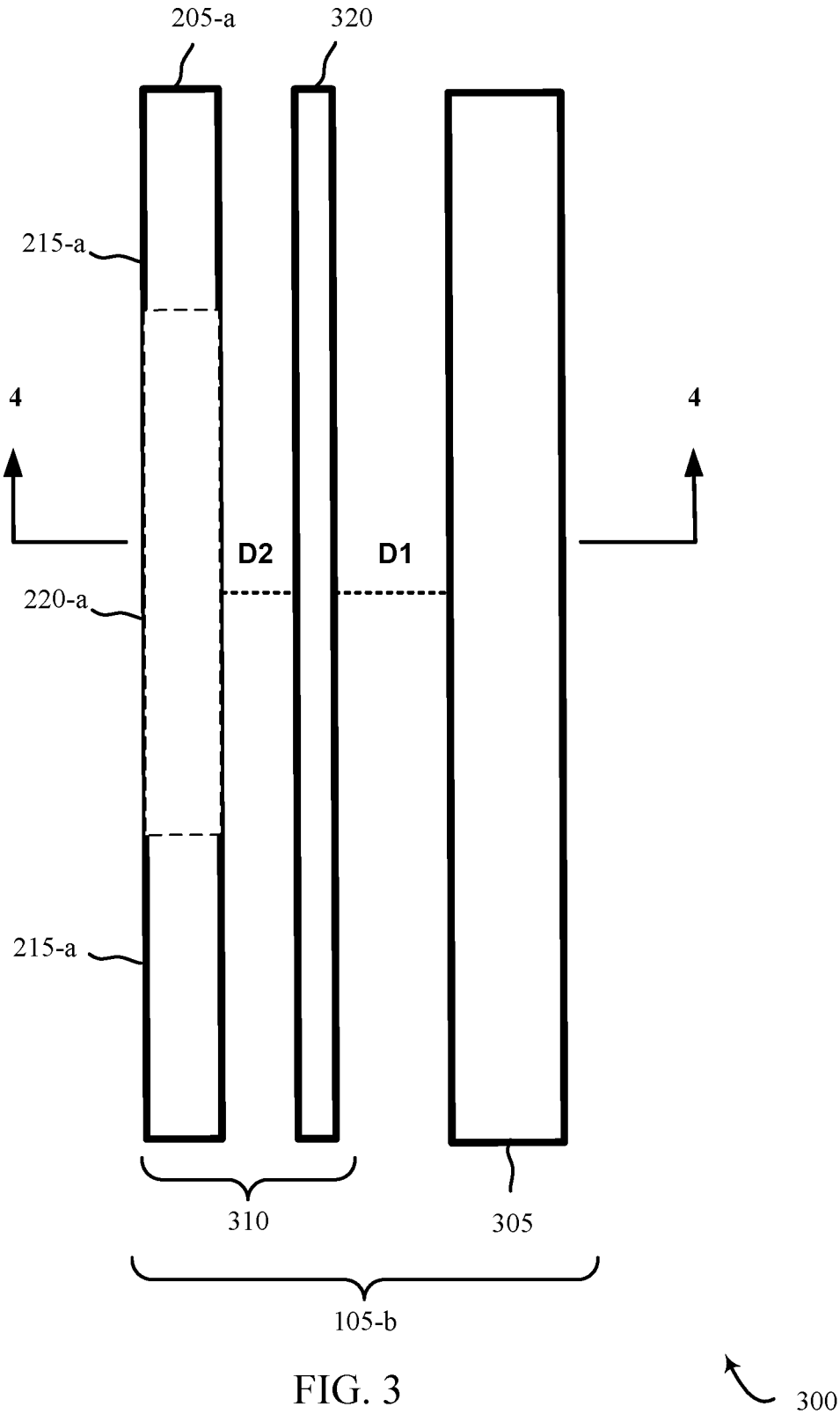
FIG. 3 is a side view of an apparatus relating to a security and/or an automation system, in accordance with various aspects of this disclosure.

FIG. 3 is a side view 300 of a hidden graphical display apparatus 105-*b*. The apparatus 105-*b* may be similar in some aspects to apparatus 105 and apparatus 105-*a* of FIG. 1 and FIGS. 2A and 2B, respectively. The apparatus 105-*b* may include a face layer 310, and a projection layer 305. Either layer may include additional layers and components. For example, the face layer 310 may include a front layer 205-*a* and a back layer 320. The front layer 205-*a* and the back layer 320 may also include additional layers and components. For example, in some embodiments, the front layer 205-*a* of the face layer 310 may include a film of optically clear plastic (such as polycarbonate) or glass, configured to be thin enough to not contribute to scattering light, yet sufficiently rigid to allow pressing of the front layer 205-*a* without resulting in damage. Some embodiments may have a small gap of air between the film or glass and the front layer, but in some examples this air gap may be minimized and/or eliminated. The front layer 205-*a*, viewed from the front, may appear similar to the front view of the front layer 205 discussed above with respect to FIGS. 2A and 2B. The front layer 205-*a* may include a first area 220-*a* and a second area 215-*a* surrounding the first area 220-*a*. The first area 220-*a* and the second area 215-*a* may be similar in some aspects to the first area 220 and second area 215 of FIGS. 2A and 2B. In some embodiments, the front layer 205-*a* may be a sufficiently thin medium to not result in excessive light scattering (of light projected thereto from the projection layer 305), yet thick enough to hide the projection layer 305 when the apparatus 105-*b* is in an inactive state.

In some embodiments, the distances between layers, such as the distance D1 between the face layer 310 and the projection layer 305, and/or the distance D2 between the front layer 205-*a* and back layer 320, may be minimized, which may in some embodiments diminish the overall thickness of the apparatus 105-*b*. Minimizing distances between layers (and thereby diminishing overall display thickness) may in some examples reduce light scattering, resulting in sharper projected images on the front layer 205-*a*. For example in one embodiment the distance D1 between the face layer 310 and the projection layer 305 may be equal to or less than 0.35 mm.

In some embodiments the front layer 205-*a* may include or be made of a plurality of pigments, optimized for displaying images (such as images 230 of FIG. 2B) in the first area 220-*a* of the front layer 205-*a*. In some examples, titanium dioxide may be used to obtain an opaque and/or white pigment. However, in some instances, too much titanium dioxide (and in some cases even a small amount), included with or applied to a clear surface, may reduce the level of transmissivity to an undesirable extent. Thus, in some embodiments, a higher level of transmissivity may be achieved without losing a white and/or opaque coloring. For example, in one embodiment this may be achieved by mixing (i.e., combining) some portion of Micah (which by itself may not create a white pigmentation but rather possibly have more of a metallic color or shimmer) along with the titanium dioxide. Thus, pigment types may vary but may for some white-colored embodiments include blends of titanium dioxide and Micah. In some such blend examples, Micah may be present in a range of 5%-20% and titanium dioxide may be present in a range of 80%-95%. One particular pigment blend embodiment may include 20% Micah and 80% titanium dioxide. Different pigment blends may also involve different levels of opacity. Cross-sectional indicators 4-4 make reference to the vertical cross section view of FIG. 4.

In some embodiments, the pigment types may be included in the face layer using silk screening techniques. For example, for some white-colored embodiments, several layers of ink including blends of titanium dioxide and Micah may be applied to the face layer using known silk-screening techniques. However, Micah may have certain properties that may make it difficult to use in some instances. For example, when heat is applied—during, for example, thermal processing to shape the face layer—or when the face layer is otherwise stretched or formed, Micah may crack or flake, causing aesthetically undesirable gaps in a white-colored ink layer (for example, on the face layer). To help avoid this, in some examples the silk screening process of applying pigment to the face layer may include applying several clear coat layers interspersed in between white ink layers (which white ink layers may include pigment blends of titanium dioxide and Micah), which may assist in keeping the white ink layers bonded together (during, for example, thermal forming processes).

Figure 4:
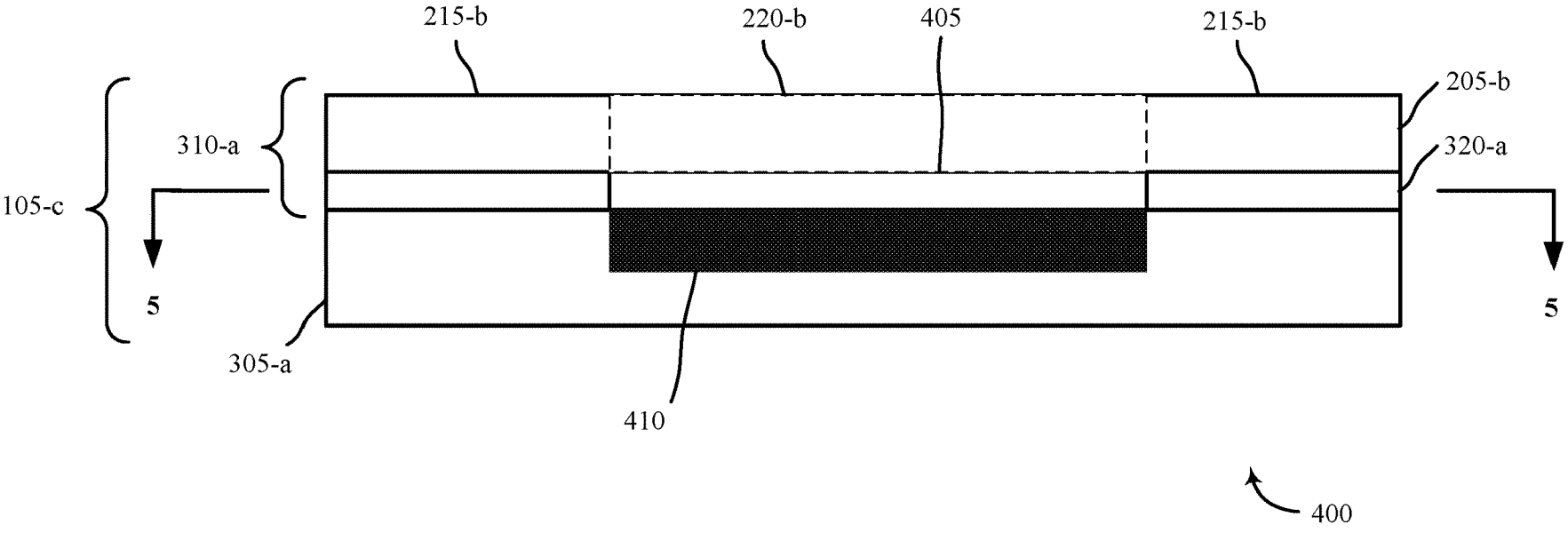
FIG. 4 is a vertical cutaway cross-section view of an apparatus relating to a security and/or an automation system, in accordance with various aspects of this disclosure.

FIG. 4 is a vertical cutaway cross section view 400 of a hidden graphical display apparatus embodiment 105-*c*, where apparatus 105-*c* may be similar in certain aspects to apparatus 105-*b* of FIG. 3. Apparatus 105-*c* may include a face layer 310-*a* and a projection layer 305-*a*. Face layer 310-*a* may include a front layer 205-*b* and a back layer 320-*a*. Front layer 205-*b* may include a first area 220-*b* and a second area 215-*b*. Face layer 310-*a* and projection layer 305-*a*, and front layer 205-*b* and back layer 320-*a*, may be similar in some aspects to face layer 310 and projection layer 305, and front layer 205-*b* and back layer 320-*a*, respectively, of FIG. 3. The back layer 320-*a* may include an aperture 405 that may be aligned with the first area 220-*b* of the front layer 205-*b*.

The projection layer 305-*a* may include a light source 410 that may be aligned with the aperture 405 of the back layer 320-*a*. In some embodiments, the light source 410 may be a high-brightness organic light-emitting diode (OLED) display, capable of displaying variable content to the first area 220-*b* of the front layer 205-*b* in the manner described. In one embodiment, the light source 410 may be bonded to the face layer 310-*a* using, for example, an optically clear adhesive, thus minimizing the distance between the projection layer 305-*a* and the face layer 310-*a*. However, it should be understood that light sources of varying brightness may be utilized, and that other components may be adjusted accordingly, in accordance with the principles described herein. Thus, as described above, different embodiments may have varying combinations of light sources, optimized pigment blends, and layers, including potentially different layer materials, thicknesses, and distances between layers. Cross-sectional indicators 5-5 make reference to the horizontal cross section view of FIG. 5.

Figure 5:
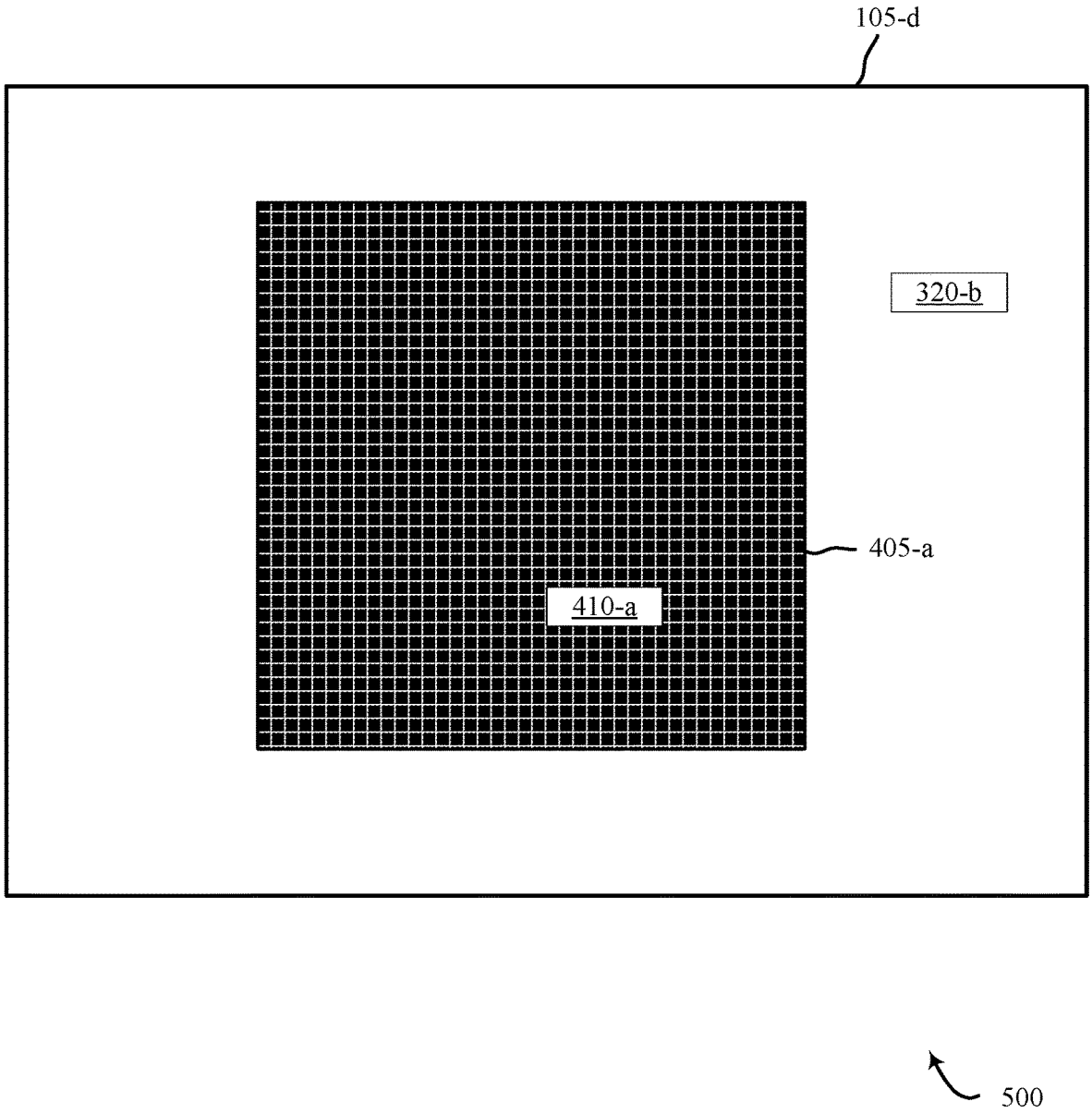
FIG. 5 is a horizontal cutaway cross-section view of an apparatus relating to a security and/or an automation system, in accordance with various aspects of this disclosure.

FIG. 5 is a horizontal cutaway cross-section view 500 of an apparatus 105-*d*, which may be similar in certain aspects to apparatus 105-*b* of FIGS. 3 and 105-*c* of FIG. 4. More specifically, cross-section view 500 shows a back layer 320-*b* (similar in some aspects to back layers 320 and 320-*a* of FIG. 3 and FIG. 4, respectively). The back layer 320-*b* may have an aperture 405-*a* (similar in certain aspects to aperture 405 of FIG. 4). The aperture 405-*a* may align with a light source 410-*a* (which light source 410-*a* may be similar in some aspects to the light source 410 of FIG. 4). In the embodiment shown, the light source 410-*a* may include a high brightness OLED. The aperture 405-*a* may be aligned with the light source 410-*a*. The light emanating from the light source 410-*a* may pass through the aperture 405-*a* (e.g., to the first area 220, 220-*a*, 220-*b* of FIG. 2B, FIG. 3, and FIG. 4, respectively). However, the rest of the back layer 320-*b* may block such light from passing through the back layer 320-*b* (e.g., from passing through to the second area 215, 215-*a*, 215-*b* of FIG. 2B, FIG. 3, and FIG. 4, respectively).

Figure 6:
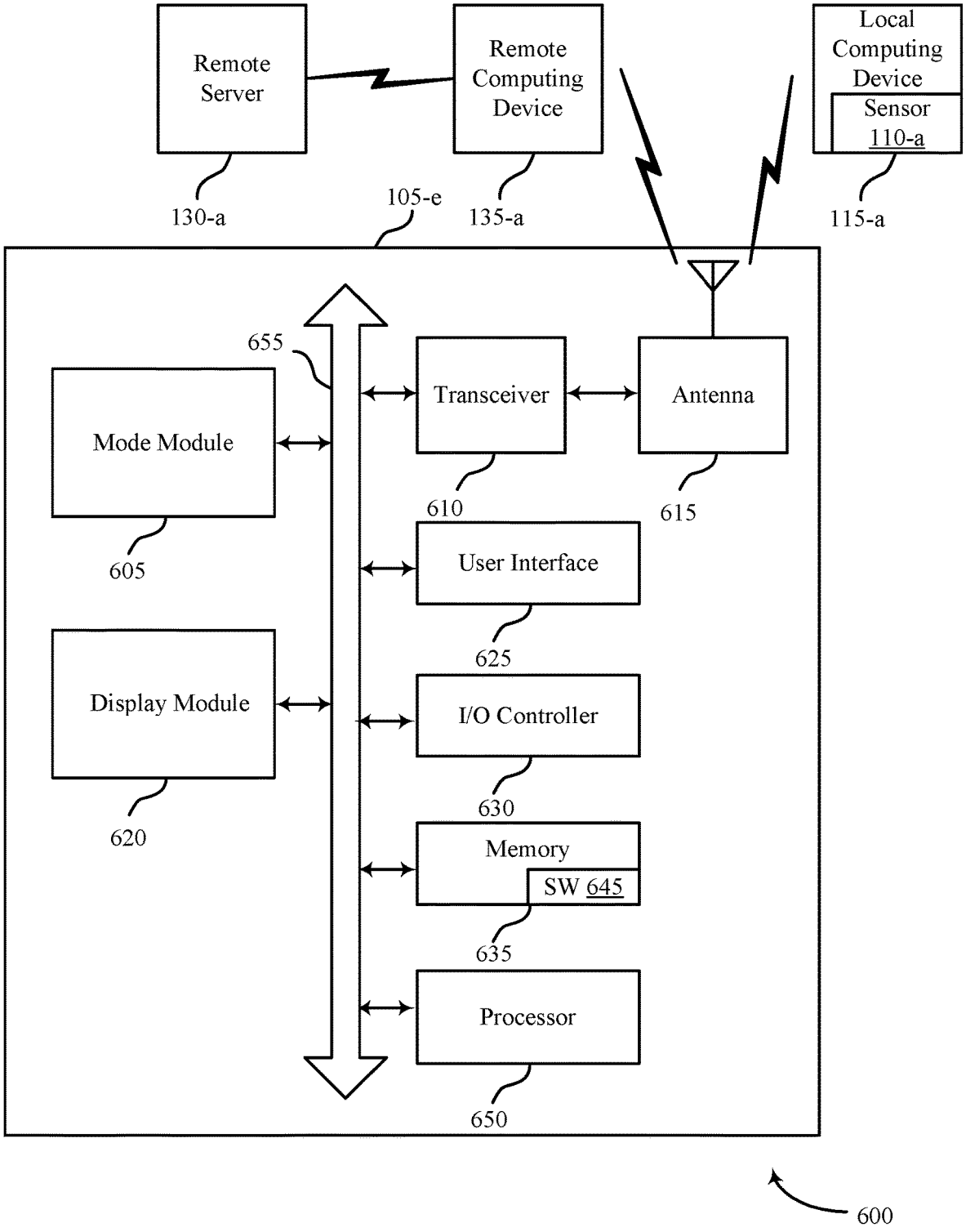
FIG. 6 shows a block diagram relating to a hidden graphical display system embodiment, in accordance with various aspects of this disclosure.

FIG. 6 shows a block diagram relating to a hidden graphical display system 600, in accordance with various aspects of this disclosure. System 600 may include an apparatus 105-*e*, which may be an example of the apparatuses 105, 105-*a*, 105-*b*, 105-*c*, and 105-*d* of FIGS. 1-5, respectively.

Apparatus 105-*e* may include a mode module 605, which may be an example of mode module 605-*a*, 605-*b* described with reference to FIGS. 7-8. Apparatus 105-*e* may include a display module 620, which may be an example of display module 620, 620-*a* described below with reference to FIGS. 7-8. In some embodiments, the terms apparatus, control panel, and control device may be used synonymously.

In some embodiments, the mode module 605 may switch the apparatus 105-*e* from an active mode to an inactive mode, and vice versa. In some examples, this switching of modes may be based at least in part on data and/or input(s) received through an optional user interface module 625, indicating user interaction, commands, and/or activity, or from a remote source such as remote computing device 640, or from a receiver module (such as the receiver modules 705, 705-*a* described below with reference to FIGS. 7-8). For example, in a wall-mounted thermostat electronic graphical display embodiment of apparatus 105-*e*, a user may touch his fingertip on a user interface (in some embodiments similar in some aspects to the interactive surface 210 of FIG. 2A and FIG. 2B, more generally to the front layers 205, 205-*a* and 205-*b* of FIGS. 2-4) related to the user interface module 625. In response, the mode module 605 may cause the apparatus 105-*e* to switch from an inactive mode to an active mode. In another example, data received from a remote computing device 640 (including in some embodiments from a remote control panel) may trigger the mode module 605 to switch from an inactive mode to an active mode. In still other embodiments, user approach or occupancy at or near apparatus 105-*e*, as detected by one or more sensor 110-*a*, may trigger mode module 605 to switch apparatus 105-*e* from an inactive mode to an active mode. In addition, the mode module 605 may cause the apparatus 105-*e* to switch back from an active mode to an inactive mode based, for example, on no input being received (e.g., from either some local input means or from some remote means, such as a remote computing device 135-*a*) for a predetermined amount of time.

The display module 620 may cause images to be displayed based at least in part on the apparatus 105-*e* being in an active mode, as previously described. For example, in the wall-mounted thermostat electronic graphical display embodiment of apparatus 105-*e* mentioned above, if the apparatus 105-*e* is in the active state the display module 620 may cause certain images to be displayed, indicating, among other things, a temperature of a home.

Apparatus 105-*e* may also include a processor module 650, and memory 635 (including software/firmware code (SW) 645), an input/output controller module 630, a user interface module 625, a transceiver module 610, and one or more antennas 615, each of which may communicate—directly or indirectly—with one another (e.g., via one or more buses 655). The transceiver module 610 may communicate bi-directionally—via the one or more antennas 615, wired links, and/or wireless links—with one or more networks or remote devices as described above. For example, the transceiver module 610 may communicate bi-directionally with one or more of local computing device 115-*a*, remote computing device 135-*a*, and/or remote server 130-*a*. The transceiver module 610 may include a modem to modulate the packets and provide the modulated packets to the one or more antennas 615 for transmission, and to demodulate packets received from the one or more antenna 615. While an apparatus (control panel or a control device, e.g., 105-*e*) may include a single antenna 615, it may also have multiple antennas 615 capable of concurrently transmitting or receiving multiple wired and/or wireless transmissions, or no antenna 615 at all. In some embodiments, one element of apparatus 105-*e* (e.g., one or more antennas 615, transceiver module 610, etc.) may provide a direct connection to a remote server 145-*a* via a direct network link to the Internet via a POP (point of presence). In some embodiments, one element of apparatus 105-*e* (e.g., one or more antennas 615, transceiver module 610, etc.) may provide a connection using wireless techniques, including digital cellular telephone connection, Cellular Digital Packet Data (CDPD) connection, digital satellite data connection, and/or another connection. In other embodiments, a connection using hardwired techniques may be provided.

The signals associated with system 600 may include wireless communication signals such as radio frequency, electromagnetics, local area network (LAN), wide area network (WAN), virtual private network (VPN), wireless network (using 802.11, for example), 345 MHz, Z-WAVE®, cellular network (using 3G and/or LTE, for example), and/or other signals. The one or more antennas 615 and/or transceiver module 610 may include or be related to, but are not limited to, WWAN (GSM, CDMA, and WCDMA), WLAN (including BLUETOOTH® and Wi-Fi), WMAN (WiMAX), antennas for mobile communications, antennas for Wireless Personal Area Network (WPAN) applications (including RFID and UWB). In some embodiments, each antenna 615 may receive signals or information specific and/or exclusive to itself. In other embodiments, each antenna 615 may receive signals or information not specific or exclusive to itself.

In some embodiments, one or more sensors 110-*a* (e.g., motion, proximity, smoke, light, glass break, door, window, carbon monoxide, and/or another sensor) may connect to some element of system 600 via a network using one or more wired and/or wireless connections.

In some embodiments, the user interface module 625 may include an audio device, such as an external speaker system, an external display device such as a display screen, and/or an input device (e.g., remote control device interfaced with the user interface module 625 directly and/or through I/O controller module 630).

One or more buses 655 may allow data communication between one or more elements of apparatus 105-*e* (e.g., processor module 650, memory 635, I/O controller module 630, user interface module 625, etc.).

The memory 635 may include random access memory (RAM), read only memory (ROM), flash RAM, and/or other types. The memory 635 may store computer-readable, computer-executable software/firmware code 645 including instructions that, when executed, cause the processor module 650 to perform various functions described in this disclosure (e.g., switching from an active mode to an inactive mode and vice versa, displaying images, processing user interaction through displayed images, etc.). Alternatively, the software/firmware code 645 may not be directly executable by the processor module 650 but may cause a computer (e.g., when compiled and executed) to perform functions described herein. Alternatively, the computer-readable, computer-executable software/firmware code 645 may not be directly executable by the processor module 650 but may be configured to cause a computer (e.g., when compiled and executed) to perform functions described herein. The processor module 650 may include an intelligent hardware device, e.g., a central processing unit (CPU), a microcontroller, an application-specific integrated circuit (ASIC), etc.

In some embodiments, the memory 635 may contain, among other things, the Basic Input-Output system (BIOS), which may control basic hardware and/or software operation such as the interaction with peripheral components or devices. For example, hardware directing the mode module 605 and the display module 620 to implement the present systems and methods may be stored within the system memory 635. Applications resident with system 600 are generally stored on and accessed via a non-transitory computer readable medium, such as a hard disk drive or other storage medium. Additionally, applications may be in the form of electronic signals modulated in accordance with the application and data communication technology when accessed via a network interface (e.g., transceiver module 610, one or more antennas 615, etc.).

Many other devices and/or subsystems may be connected to one or may be included as one or more elements of system 600 (e.g., entertainment system, computing device, remote cameras, wireless key fob, wall mounted user interface device, cell radio module, battery, alarm siren, door lock, lighting system, thermostat, home appliance monitor, utility equipment monitor, and so on). In some embodiments, all of the elements shown in FIG. 6 need not be present to practice the present systems and methods. The devices and subsystems may be interconnected in different ways from that shown in FIG. 6. In some embodiments, an aspect of some operation of a system, such as that shown in FIG. 6, may be readily known in the art and are not discussed in detail in this application. Code to implement the present disclosure may be stored in a non-transitory computer-readable medium such as one or more of system memory 635 or other memory. The operating system provided on I/O controller module 420 may be iOS®, ANDROID®, MS-DOS®, MS-WINDOWS®, OS/2®, UNIX®, LINUX®, or another known operating system.

Figure 7:
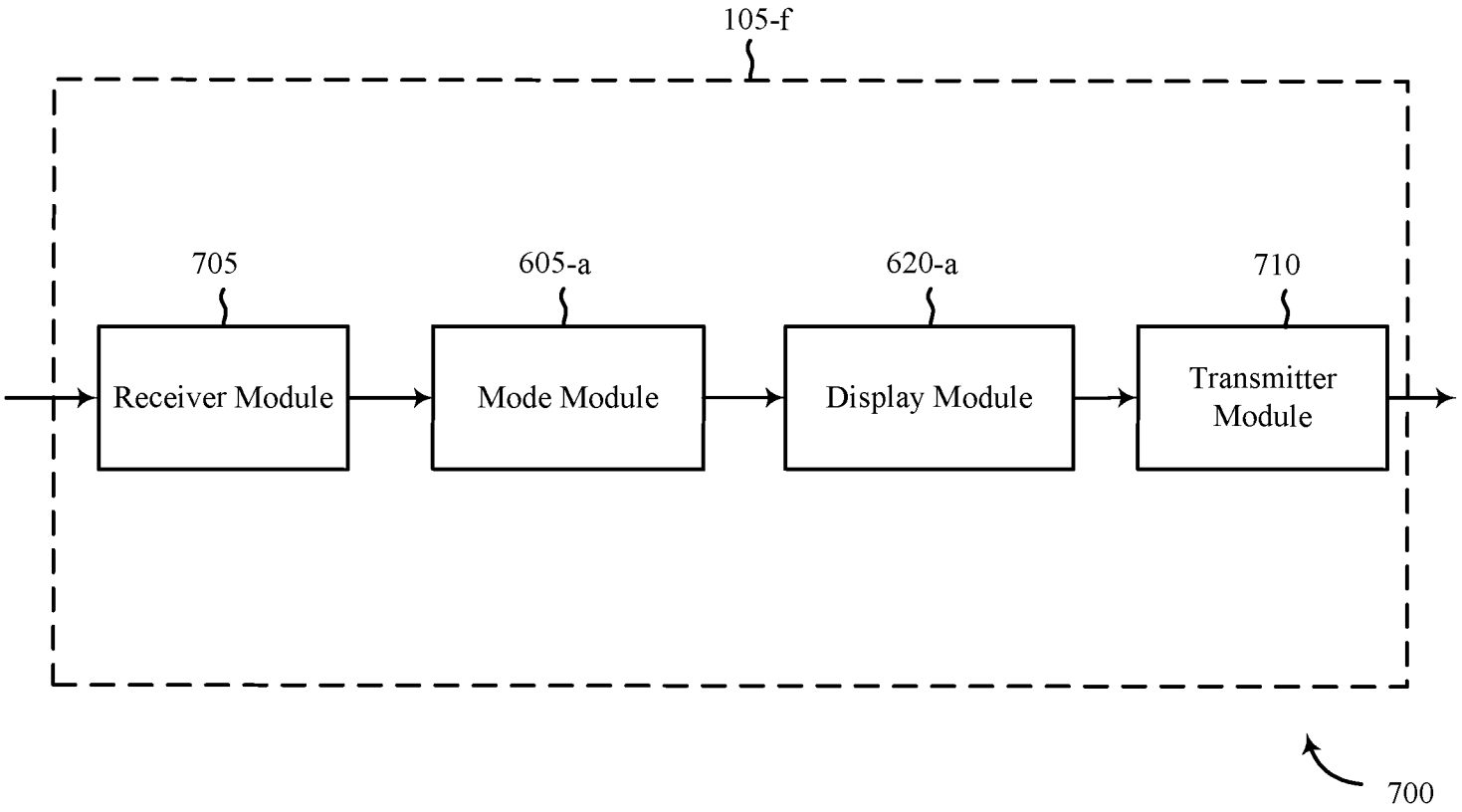
FIG. 7 shows a block diagram of a hidden graphical display apparatus embodiment in accordance with various aspects of this disclosure.

FIG. 7 shows a block diagram 700 of a hidden graphical display apparatus 105-*f*, relating to a security and/or an automation system, in accordance with various aspects of this disclosure. The apparatus 105-*f* may be an example of one or more aspects of the apparatuses 105, 105-*a*, 105-*b*, 105-*c*, 105-*d*, and 105-*e* described with reference to FIGS. 1-6, respectively. The apparatus 105-*f* may include a receiver module 705, a mode module 605-*a*, a display module 620-*a*, and/or a transmitter module 710. The apparatus 105-*f* may also be or include a processor. Each of these modules may be in communication with each other—directly and/or indirectly.

The components of the apparatus 105-*f* may, individually or collectively, be implemented using one or more application-specific integrated circuits (ASICs) adapted to perform some or all of the applicable functions in hardware. Alternatively, the functions may be performed by one or more other processing units (or cores), on one or more integrated circuits. In other examples, other types of integrated circuits may be used (e.g., Structured/Platform ASICs, Field Programmable Gate Arrays (FPGAs), and other Semi-Custom ICs), which may be programmed in any manner known in the art. The functions of each module may also be implemented—in whole or in part—with instructions embodied in memory formatted to be executed by one or more general and/or application-specific processors.

The receiver module 705 may receive information such as packets, user data, and/or control information associated with various information channels (e.g., control channels, data channels, etc.). The receiver module 705 may be configured to receive input regarding user commands, environmental conditions (in some embodiments received from sensors, such as for example sensors 110 of FIG. 1), etc. Information received at receiver module 705 may be passed on to the mode module 605-*a*, display module 620-*a*, and to other components of the apparatus 105-*f*.

Similar in some aspects to mode module 605 discussed above with respect to FIG. 6, the mode module 605-*a* may switch the apparatus 105-*f* from an active mode to an inactive mode, and vice versa. In some examples, this switching of modes may be based at least in part on data and/or input(s) received from the receiver module 705. For example, data received from the receiver module 705 may indicate receipt of an inputted command at the apparatus 105-*f*, and the mode module 605-*a* may switch the apparatus 105-*f* from an active state to an inactive state based at least in part on this inputted command. Such received data may be based on user interaction that is local to or remote from the apparatus 105-*f* For example, in an example of local user interaction, data received from the receiver module 705 may indicate that a user is touching his fingertip to a first area of a front layer (e.g., the front layers 205, 205-*a*, and 205-*b* of apparatuses 105-*a*, 105-*b*, and 105-*c* of FIGS. 2-4) of the apparatus 105-*f*, or some other area or button that may indicate a user interaction attempt, and in response the mode module 605-*a* may cause the apparatus 105-*f* to switch from the inactive mode to the active mode. The mode module 605-*a* may also cause apparatus 105-*f* to switch from the inactive mode to the active mode based on other varying types of data received from the receiver module 705 (e.g., data captured by some sensor 110 of FIG. 1). For example, the mode module 605-*a* may receive data from the receiver module 705 indicating that a person has entered a room where the apparatus 105-*f* may be located, or that a person is speaking a recognized voice command, or based on the use of an electronic device, or appliance, or other home feature (e.g., fireplace), etc. The mode module 605-*a* may also cause apparatus 105-*f* to switch from the inactive mode to the active mode based on a timer or predetermined time, among other examples.

The display module 620-*a* may cause images to be displayed or not displayed based at least in part on the mode of the apparatus 105-*f*. For example, if the apparatus 105-*f* is in the active mode, the display module 620-*a* may cause certain images to be displayed. For example, in a wall-mounted thermostat electronic graphical display embodiment of apparatus 105-*f*, the display module may display images indicating a temperature of a home, or in the case of such an embodiment with an interactive display interface, the display module may display images indicating to the user where to press or touch in order to input a command.

The transmitter module 710 may transmit the one or more signals received from other components of the apparatus 105-*f* The transmitter module 710 may transmit, for example, signals to the apparatus 105-*f* initiating a switch from an inactive mode to an active mode (and vice versa), and/or signals indicating what images to display, and/or other commands. In some examples, the transmitter module 710 may be collocated with the receiver module 705 in a transceiver module.

Figure 8:
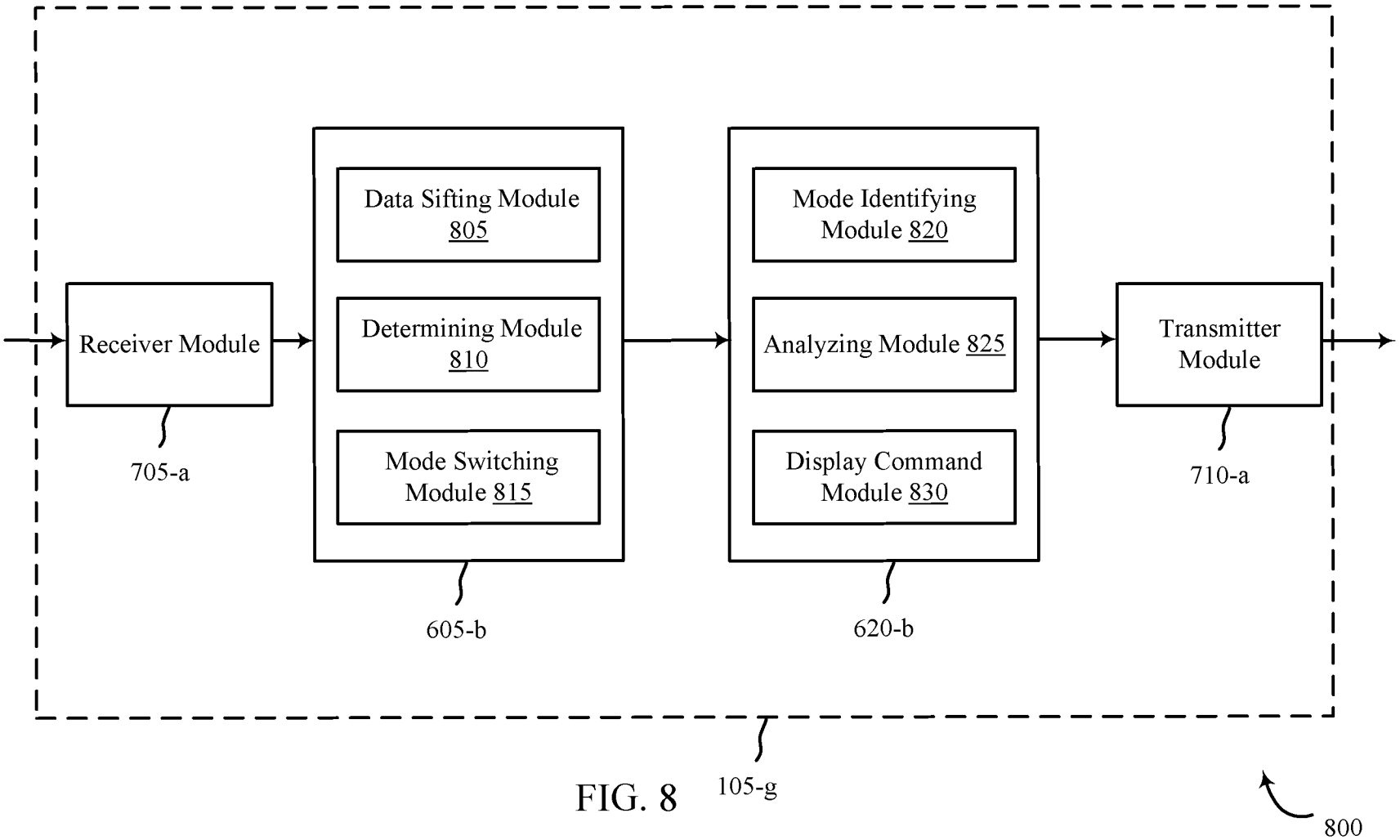
FIG. 8 shows a block diagram of a hidden graphical display apparatus embodiment in accordance with various aspects of this disclosure.

FIG. 8 shows a block diagram 800 of a hidden graphical display apparatus 105-*g*, in accordance with various aspects of this disclosure. The apparatus 105-*f* may be an example of one or more aspects of the apparatuses 105, 105-*a*, 105-*b*, 105-*c*, 105-*d*, 105-*e*, and 105-*f* described with reference to FIGS. 1-7, respectively. The apparatus 105-*f* may include a receiver module 705-*a*, a mode module 605-*b*, display module 620-*b*, and/or a transmitter module 710-*a*, which may be examples of the corresponding modules of FIG. 7. The apparatus 105-*g* may also include a processor. Each of these components may be in communication with each other.

The mode module 605-*b* may include variety of modules related to performing the operations described above with respect to FIG. 7. For example, the mode module 605-*b* may include, but is not limited to including, a data sifting module 805, a determining module 810, and/or a mode switching module 815. In some examples, the data sifting module 805 may sift through the data received from the receiver module 705-*a* to identify data relevant to determining whether or not to switch modes. Information that is not relevant to that determination may be passed on to the display module 620-*b* or ignored. The determining module 810 may evaluate the data received from the receiver module 705-*a* that is relevant to the determination of whether or not to switch modes. Then the determination module 810 may make the determination of whether or not to switch modes (as, for example, described above with respect to FIG. 7). Once the determination of whether or not to switch modes is made, the mode switching module 815 may initiate that switch.

In some examples, the display module 620-*b* may include, but is not limited to including, a mode identifying module 820, an analyzing module 825, and/or a display command module 830. The mode identifying module 820 may identify the mode of the apparatus 105-*g*, and/or the signal initiated by the mode switching module 815 for the apparatus 105-*g* to switch to a certain mode. The analyzing mode may then analyze the data received from the receiver module 705-*a*, and from the mode identifying module 820, to determine whether to display any images and if so, what images to display. In varying examples, the analyzing module 825 may analyze a variety of data received from the receiver module 705-*a* in order to determine what images to display and how to display those images. For example, in one embodiment, the analyzing module 825 may determine an ambient light level of a room and determine a brightness level of the displayed images based at least in part on that data. In addition, based at least in part on this analysis, the display command module 830 may signal to the transmitter module 710-*a* to issue related commands to the apparatus 105-*g*. The receiver module 705-*a* and the transmitter module 710-*a* may perform the functions of the receiver module 705 and the transmitter module 710, of FIG. 7, respectively.

The components of the apparatus 105-*g* may, individually or collectively, be implemented using one or more application-specific integrated circuits (ASICs) adapted to perform some or all of the applicable functions in hardware. Alternatively, the functions may be performed by one or more other processing units (or cores), on one or more integrated circuits. In other examples, other types of integrated circuits may be used (e.g., Structured/Platform ASICs, Field Programmable Gate Arrays (FPGAs), and other Semi-Custom ICs), which may be programmed in any manner known in the art. The functions of each module may also be implemented—in whole or in part—with instructions embodied in memory formatted to be executed by one or more general and/or application-specific processors.

Figure 9:
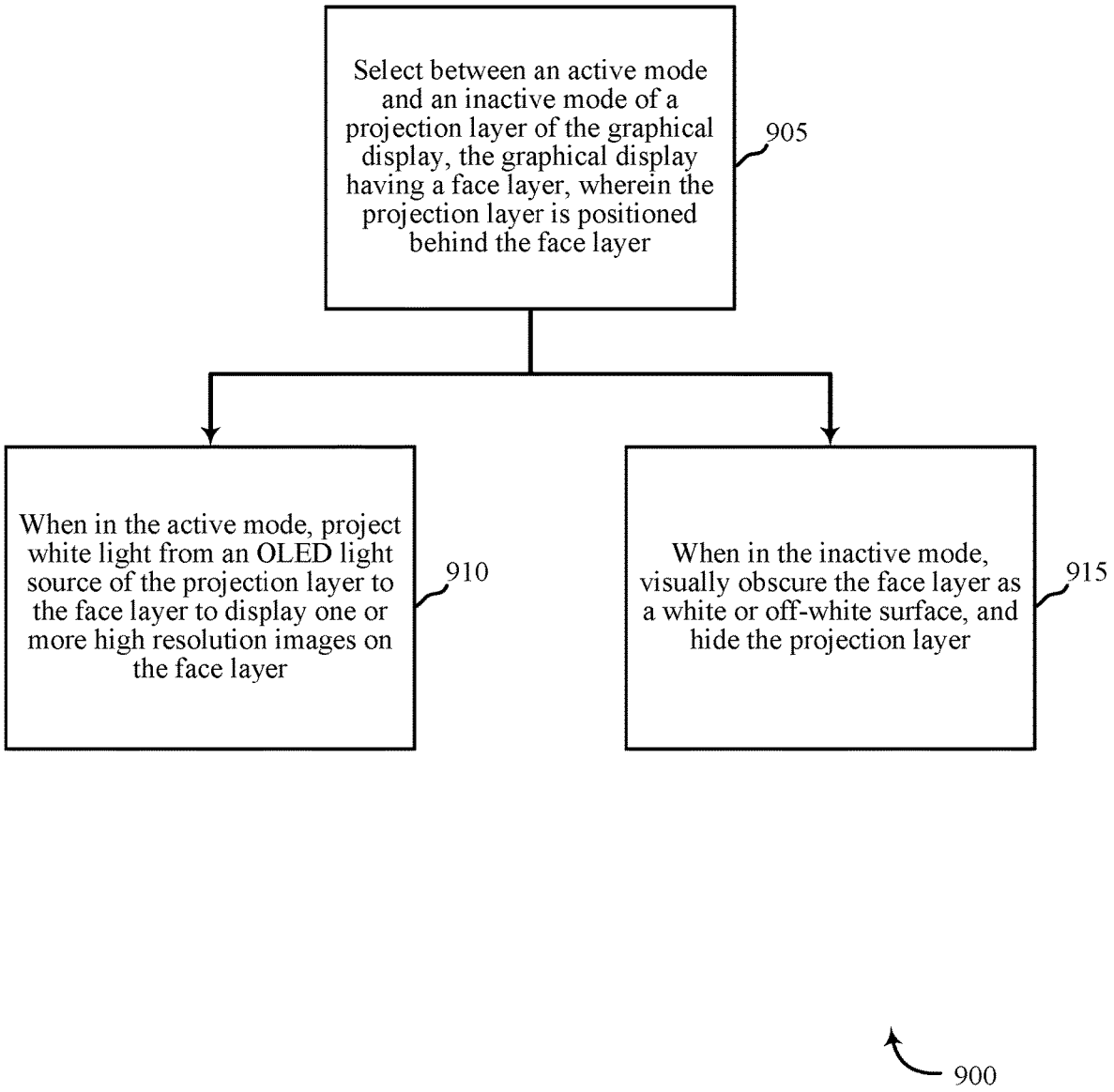
FIG. 9 is a flow chart illustrating an example of a method for visually obscuring a graphical display in accordance with various aspects of this disclosure.

FIG. 9 is a flow chart illustrating an example of a method 900 for visually obscuring a graphical display in accordance with various aspects of this disclosure. For clarity, the method 900 is described below with reference to aspects of one or more of the features, layers, and/or components described with reference to FIGS. 2A-8. For example, the method 900 of obscuring a graphical display may involve a graphical display apparatus that has a face layer and a projection layer, the latter positioned behind the face layer. In some examples, the graphical display apparatus may execute one or more sets of codes to control the functional elements of the projection layer (including the light source) and the face layer to perform the functions described below. Additionally or alternatively, the apparatus may perform one or more of the functions described below using special-purpose hardware.

At block 905, the method 900 may include selecting between an active mode and an inactive mode of the projection layer of the graphical display. Although the projection layer of the graphical display may have an active mode and an inactive mode, in some examples the apparatus may not necessarily be completely "off" in the inactive mode. For example, in some embodiments the apparatus may still perform some functions and/or operations while in the inactive mode. The operation(s) at block 905 may be performed, for example (and not in a limiting manner), using the mode module 605, 605-*a*, 605-*b*, and the transceiver module 610 and the transmitter module 710-, 710-*a* described with reference to FIGS. 6-8.

At block 910, the method 900 may include, when in the active mode, projecting white light from an OLED light source of the projection layer to the face layer to display one or more high resolution images on the face layer. Thus, in some embodiments of method 900, the projection layer may include a light source, which in some examples may include an OLED. In addition, in some embodiments, the face layer may include a plurality of pigments. In some of these embodiments, the plurality of pigments may include at least one part Micah and at least one part titanium dioxide, and in some particular embodiments, Micah may be present in a range of 5%-20% and titanium dioxide may be present in a range of 80%-95%. The operation at block 910 may be performed, for example (and not in a limiting manner), using the mode module 605, 605-*a*, 605-*b*, the display module 620, 620-*a*, 620-*b*, and the transceiver module 610 and transmitter module 710, 710-*a* described with reference to FIGS. 6-8, as well as the front layer 205, 205-*a*, 205-*b*, face layer 310, 310-*a*, and projection layer 305, 305-*a* of FIGS. 2A-5.

At block 915, the method 900 may include, when in the inactive mode, visually obscuring the face layer as a white or off-white surface, and hiding the projection layer. The operation at block 910 may be performed, for example (and not in a limiting manner), using the same or some of the same (and also different) modules and structures mentioned with respect to block 905.

Thus, the method 900 may provide for visually obscuring a graphical display, which display may in some examples relate to automation/security systems. It should be noted that the method 900 is just one implementation and that the operations of the method 000 may be rearranged or otherwise modified such that other implementations are possible.

In some examples, aspects from method 900 may be combined and/or separated. It should be noted that the method 900 is just an example implementation, and that the operations of the method 900 may be rearranged or otherwise modified such that other implementations are possible.

The detailed description set forth above in connection with the appended drawings describes examples and does not represent the only instances that may be implemented or that are within the scope of the claims. The terms "example" and "exemplary," when used in this description, mean "serving as an example, instance, or illustration," and not "preferred" or "advantageous over other examples." The detailed description includes specific details for the purpose of providing an understanding of the described techniques. These techniques, however, may be practiced without these specific details. In some instances, known structures and apparatuses are shown in block diagram form in order to avoid obscuring the concepts of the described examples.

Information and signals may be represented using any of a variety of different technologies and techniques. For example, data, instructions, commands, information, signals, bits, symbols, and chips that may be referenced throughout the above description may be represented by voltages, currents, electromagnetic waves, magnetic fields or particles, optical fields or particles, or any combination thereof.

The various illustrative blocks and components described in connection with this disclosure may be implemented or performed with a general-purpose processor, a digital signal processor (DSP), an ASIC, an FPGA or other programmable logic device, discrete gate or transistor logic, discrete hardware components, or any combination thereof designed to perform the functions described herein. A general-purpose processor may be a microprocessor, but in the alternative, the processor may be any conventional processor, controller, microcontroller, and/or state machine. A processor may also be implemented as a combination of computing devices, e.g., a combination of a DSP and a microprocessor, multiple microprocessors, one or more microprocessors in conjunction with a DSP core, and/or any other such configuration.

The functions described herein may be implemented in hardware, software executed by a processor, firmware, or any combination thereof. If implemented in software executed by a processor, the functions may be stored on or transmitted over as one or more instructions or code on a computer-readable medium. Other examples and implementations are within the scope and spirit of the disclosure and appended claims. For example, due to the nature of software, functions described above can be implemented using software executed by a processor, hardware, firmware, hardwiring, or combinations of any of these. Features implementing functions may also be physically located at various positions, including being distributed such that portions of functions are implemented at different physical locations.

As used herein, including in the claims, the term "and/or," when used in a list of two or more items, means that any one of the listed items can be employed by itself, or any combination of two or more of the listed items can be employed. For example, if a composition is described as containing components A, B, and/or C, the composition can contain A alone; B alone; C alone; A and B in combination; A and C in combination; B and C in combination; or A, B, and C in combination. Also, as used herein, including in the claims, "or" as used in a list of items (for example, a list of items prefaced by a phrase such as "at least one of" or "one or more of") indicates a disjunctive list such that, for example, a list of "at least one of A, B, or C" means A or B or C or AB or AC or BC or ABC (i.e., A and B and C).

In addition, any disclosure of components contained within other components or separate from other components should be considered exemplary because multiple other architectures may potentially be implemented to achieve the same functionality, including incorporating all, most, and/or some elements as part of one or more unitary structures and/or separate structures.

Computer-readable media includes both computer storage media and communication media including any medium that facilitates transfer of a computer program from one place to another. A storage medium may be any available medium that can be accessed by a general purpose or special purpose computer. By way of example, and not limitation, computer-readable media can comprise RAM, ROM, EEPROM, flash memory, CD-ROM, DVD, or other optical disk storage, magnetic disk storage or other magnetic storage devices, or any other medium that can be used to carry or store desired program code means in the form of instructions or data structures and that can be accessed by a general-purpose or special-purpose computer, or a general-purpose or special-purpose processor. Also, any connection is properly termed a computer-readable medium. For example, if the software is transmitted from a website, server, or other remote source using a coaxial cable, fiber optic cable, twisted pair, digital subscriber line (DSL), or wireless technologies such as infrared, radio, and microwave, then the coaxial cable, fiber optic cable, twisted pair, DSL, or wireless technologies such as infrared, radio, and microwave are included in the definition of medium. Disk and disc, as used herein, include compact disc (CD), laser disc, optical disc, digital versatile disc (DVD), floppy disk and Blu-ray disc where disks usually reproduce data magnetically, while discs reproduce data optically with lasers. Combinations of the above are also included within the scope of computer-readable media.

The previous description of the disclosure is provided to enable a person skilled in the art to make or use the disclosure. Various modifications to the disclosure will be readily apparent to those skilled in the art, and the generic principles defined herein may be applied to other variations without departing from the scope of the disclosure. Thus, the disclosure is not to be limited to the examples and designs described herein but is to be accorded the broadest scope consistent with the principles and novel features disclosed.

This disclosure may specifically apply to security system applications. This disclosure may specifically apply to automation system applications. In some embodiments, the concepts, the technical descriptions, the features, the methods, the ideas, and/or the descriptions may specifically apply to security and/or automation system applications. Distinct advantages of such systems for these specific applications are apparent from this disclosure.

The process parameters, actions, and steps described and/or illustrated in this disclosure are given by way of example only and can be varied as desired. For example, while the steps illustrated and/or described may be shown or discussed in a particular order, these steps do not necessarily need to be performed in the order illustrated or discussed. The various exemplary methods described and/or illustrated here may also omit one or more of the steps described or illustrated here or include additional steps in addition to those disclosed.

Furthermore, while various embodiments have been described and/or illustrated here in the context of fully functional computing systems, one or more of these exemplary embodiments may be distributed as a program product in a variety of forms, regardless of the particular type of computer-readable media used to actually carry out the distribution. The embodiments disclosed herein may also be implemented using software modules that perform certain tasks. These software modules may include script, batch, or other executable files that may be stored on a computer-readable storage medium or in a computing system. In some embodiments, these software modules may permit and/or instruct a computing system to perform one or more of the exemplary embodiments disclosed here.

This description, for purposes of explanation, has been described with reference to specific embodiments. The illustrative discussions above, however, are not intended to be exhaustive or limit the present systems and methods to the precise forms discussed. Many modifications and variations are possible in view of the above teachings. The embodiments were chosen and described in order to explain the principles of the present systems and methods and their practical applications, to enable others skilled in the art to utilize the present systems, apparatus, and methods and various embodiments with various modifications as may be suited to the particular use contemplated.

What is claimed is:

1. A hidden graphical display apparatus for an automation and/or security system, comprising:

a face layer and a projection layer, the projection layer positioned behind the face layer;

the face layer comprising a front side and a back side, the front side comprising a first area configured to display high resolution images and a second area positioned around the first area, the first area and the second area being comprised of the same material, and the face layer comprising a plurality of pigments, wherein a plurality of coats of the plurality of pigments are applied to the face layer such that a plurality of clear coat layers are interspersed in between a plurality of white ink layers to avoid undesirable gaps in the white ink layers and to keep the white ink layers bonded together during a thermal process to set the face layer, and wherein the front side of the face layer further comprises a polycarbonate sheet, and wherein the back side of the face layer further comprises a mask layer comprising an aperture aligned with the first area of the front side of the face layer;

the projection layer comprising a light source configured to operate in an active mode and an inactive mode.

2. The apparatus of claim 1, wherein the plurality of pigments comprise at least one part Micah and at least one part titanium dioxide.

3. The apparatus of claim 2, wherein the plurality of pigments comprise Micah in a range of 5%-20% and titanium dioxide in a range of 80%-95%.

4. The apparatus of claim 1, wherein the plurality of white ink layers comprise at least one part Micah and at least one part titanium dioxide.

5. The apparatus of claim 1, wherein the light source comprises an organic light-emitting diode (OLED).

6. The apparatus of claim 5, wherein the OLED light source of the projection layer is bonded to at least a part of the face layer.

7. The apparatus of claim 1, wherein the projection layer and the face layer are positioned a distance apart, the distance comprising a range of 0-0.35 millimeters.

8. The apparatus of claim 1, wherein: when in the active mode, the projection layer is configured to project white light from the light source to the back side of the face layer to display one or more white high resolution images in the first area, and wherein the first area other than the displayed white high resolution images comprises a white background to the displayed white high resolution images when in the active mode.

9. The apparatus of claim 1, wherein: when in the inactive mode, the projection layer is configured to visually obscure the face layer so that the first area and the second area together display a colored surface hiding the projection layer.

10. The apparatus of claim 1, wherein the back side of the face layer is configured to transmit 15%-45% of the projected white light.

11. The apparatus of claim 1, wherein the face layer further comprises:

an interactive surface.

12. A method of visually obscuring a graphical display, the method comprising:

selecting between an active mode and an inactive mode of a projection layer of the graphical display, the graphical display having a face layer, wherein the projection layer is positioned behind the face layer, the face layer comprising a front side and a back side, the front side comprising a first area configured to display high resolution images and a second area positioned around the first area, the first area and the second area being comprised of the same material, and the face layer comprising a plurality of pigments, wherein a plurality of coats of the plurality of pigments are applied to the face layer such that a plurality of clear coat layers are interspersed in between a plurality of white ink layers to avoid undesirable gaps in the white ink layers and to keep the white ink layers bonded together during a thermal process to set the face layer, and wherein the front side of the face layer further comprises a polycarbonate sheet, and wherein the back side of the face layer further comprises a mask layer comprising an aperture aligned with the first area of the front side of the face layer.

13. The method of claim 12, further comprising:

projecting, when in active mode, white light from a OLED light source of the projection layer to the back side of the face layer to display one or more white high resolution images in the first area, and wherein the first area other than the displayed white high resolution images comprises a white background to the displayed white high resolution images against a white background of the face layer.

14. The method of claim 12, further comprising:

visually obscuring, when in the inactive mode, the face layer such that the first area and the second area together display a white or off-white surface; and hiding the projection layer, wherein the first area and the second area are both comprised of the same material.

15. A non-transitory computer-readable medium storing computer-executable code, the code executable by a processor to:

select between an active mode and an inactive mode of a projection layer of the graphical display, the graphical display having a face layer and the projection layer, wherein the projection layer is positioned behind the face layer, the face layer comprising a front side and a back side, the front side comprising a first area configured to display high resolution images and a second area positioned around the first area, the first area and the second area being comprised of the same material, and the face layer comprising a plurality of pigments, wherein a plurality of coats of the plurality of pigments are applied to the face layer such that a plurality of clear coat layers are interspersed in between a plurality of white ink layers to avoid undesirable gaps in the white ink layers and to keep the white ink layers bonded together during a thermal process to set the face layer, and the plurality of pigments comprising Micah in a range of 5%-20% and titanium dioxide in a range of 80%-95%, wherein the front side of the face layer further comprises a polycarbonate sheet, and wherein the back side of the face layer further comprises a mask layer comprising an aperture aligned with the first area of the front side of the face layer.

* * * * *